US006877880B2

(12) United States Patent
Endo

(10) Patent No.: US 6,877,880 B2
(45) Date of Patent: Apr. 12, 2005

(54) ELECTRIC LIGHT FOR WORK

(76) Inventor: Toshiaki Endo, #201, 31-7, Kitami 4-chome, Setagaya-ku, Tokyo (JP)

( * ) Notice: Subject to any disclaimer, the term of this patent is extended or adjusted under 35 U.S.C. 154(b) by 79 days.

(21) Appl. No.: 10/318,566

(22) Filed: Dec. 13, 2002

(65) Prior Publication Data

US 2004/0114376 A1 Jun. 17, 2004

(51) Int. Cl.[7] ..... F21V 14/04

(52) U.S. Cl. ..... 362/282; 362/191; 362/269; 362/287; 362/296; 362/322; 362/341; 362/372; 362/398; 362/427; 362/430; 362/202; 362/197

(58) Field of Search ..... 362/282, 190, 362/191, 269, 287, 296, 322, 341, 372, 398, 427, 430, 202, 197, 800, 486

(56) References Cited

U.S. PATENT DOCUMENTS 3,601,595 A * 8/1971 Kivela ..... 362/190
3,917,940 A * 11/1975 Duddy ..... 362/398
4,428,033 A * 1/1984 McBride ..... 362/183
6,176,592 B1 * 1/2001 Kovacik et al. ..... 362/199
6,186,651 B1 * 2/2001 Sayers et al. ..... 362/512
6,280,042 B1 * 8/2001 Wegrzyn et al. ..... 362/20

* cited by examiner

*Primary Examiner*—Sandra O'Shea
*Assistant Examiner*—Sharon Payne
(74) *Attorney, Agent, or Firm*—Jordan and Hamburg LLP

(57) ABSTRACT

An electric light for work comprises a support stand, capable of being magnetically fixed to a metal surface; a reflector, formed in the shape of a semicircle arc, attached rotatably to the support stand in the vertical direction at a predetermined range; and a lighting device attached so that a luminous body is arranged into the reflector, illuminated the luminous body by a battery attached to the reflector so that the electric light can be illuminated in the place that it is narrow and entered spaces and can be magnetically fixed anywhere when it is metal material, and can be performed to repair with both hands illuminating a work place.

5 Claims, 12 Drawing Sheets

ELECTRIC LIGHT FOR WORK

BACKGROUND OF THE INVENTION

This invention relates to an electric light for work used in case of the reconditioning a car etc.

The kind of conventional electric light for work is used the light covered by the lattice-like cover around the perimeter part thereof and installed in the floor, the pencil type flashlight and the like.

By the conventional electric light for work, when an engine room etc. is fixed, a repair part 10 has not been illuminated. Moreover, even if it is illuminated, the worker has to have the flashlight single hand, and workability is bad.

Moreover, since the pencil-typed flashlight is cylindrical, it can perform only lighting of the vertical direction in narrow space, and it is impossible to light a part that entered the side from the space of the vertical direction.

SUMMARY OF THE INVENTION

In light of the forgoing, it is an object of the present invention to provide an electric light for work that can be illuminated in the place that it is narrow and entered spaces.

It is another object of the present invention to provide the electric light for work that can be magnetically fixed anywhere when it is metal material, and can be performed to repair with both hands illuminating a work place.

Novel features which are believed to be characteristic of the invention, both as to its organization and method of operation, together with further objects and advantages thereof, are 25 described below with reference to the accompanying drawings in which preferred embodiments of the invention are illustrated as an example.

It is to be expressly understood, however, that the drawings are for the purpose of illustration and description only, and are not intended as a definition of the limits of the invention.

DETAILED DESCRIPTION OF THE PREFERRED EMBODIMENTS

Figure 1:
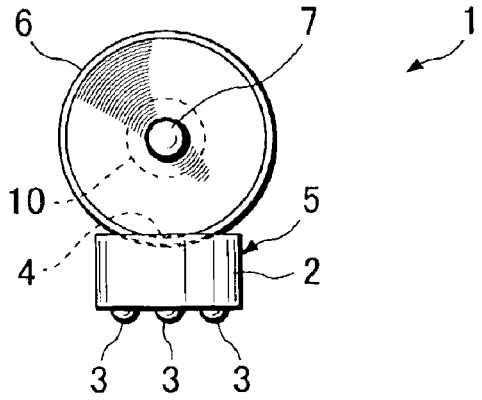
FIG. 1 is a front view showing a first embodiment of the present invention.
Figure 2:
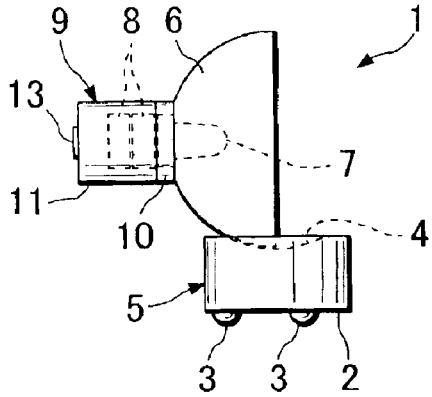
FIG. 2 is a side view.
Figure 3:
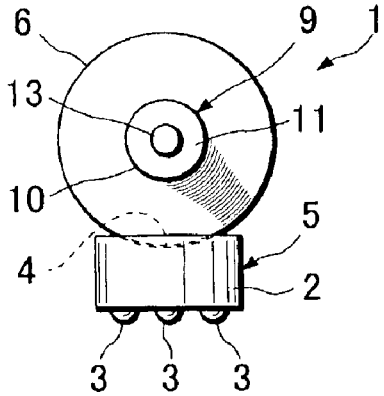
FIG. 3 is a back view.
Figure 4:
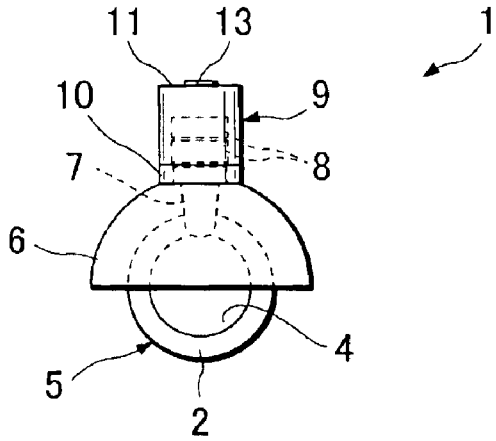
FIG. 4 is a plan view.
Figure 5:
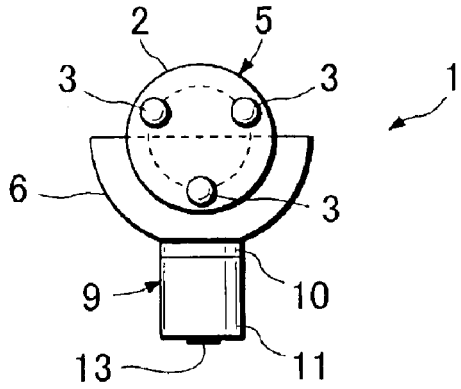
FIG. 5 is a bottom view.
Figure 6:
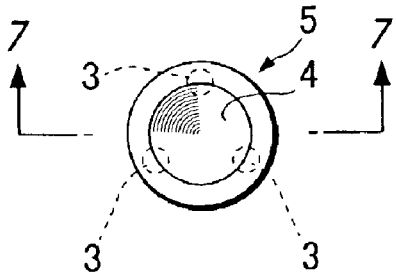
FIG. 6 is an explanation view of a support stand.
Figure 7:
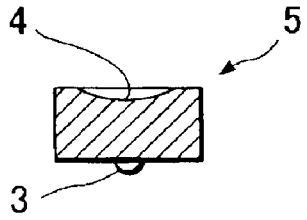
FIG. 7 is a sectional view taken on the line 7—7 of FIG. 6.
Figure 8:
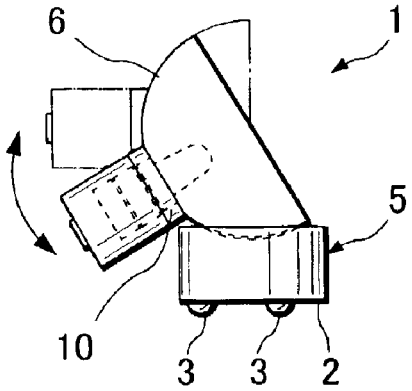
FIG. 8 is an explanation view in use.

Preferred embodiments of the present invention are described in more detail below referring to the accompanying drawings.

An understanding of the present invention may be best gained by reference to FIGS. 1–9. FIGS. 1–9 illustrate an electric light for work in accordance with a first embodiment of the present invention. Reference numeral 1 shows the electric light for work of the present invention which can stick to a metal portion and can illuminate a work portion etc., forming a small appearance, comprises a support stand 5 including; a support stand body 2 formed in the magnetic material of the shape of a disk with a diameter of 20 mm and a height size of 10 mm; three hemispheric leg members 3, 3, 3 fixed to the undersurface of the support stand body 2; and a concave member 4 having arc-shape formed in an upper surface of the support stand body 2, a reflector 6 made from metal material and formed in the shape of a semicircle arc substantially having 30 mm of a diameter, magnetically connecting the reflector to the stand so that the reflector may rotate in the vertical direction at predetermined range to the concave member 4 of the support stand 5, and a lighting device 9 illuminated a luminous body 7 by a battery 8 attached in the reflector 6 so that the luminous body 7 is located into the reflector 6.

Figure 9:
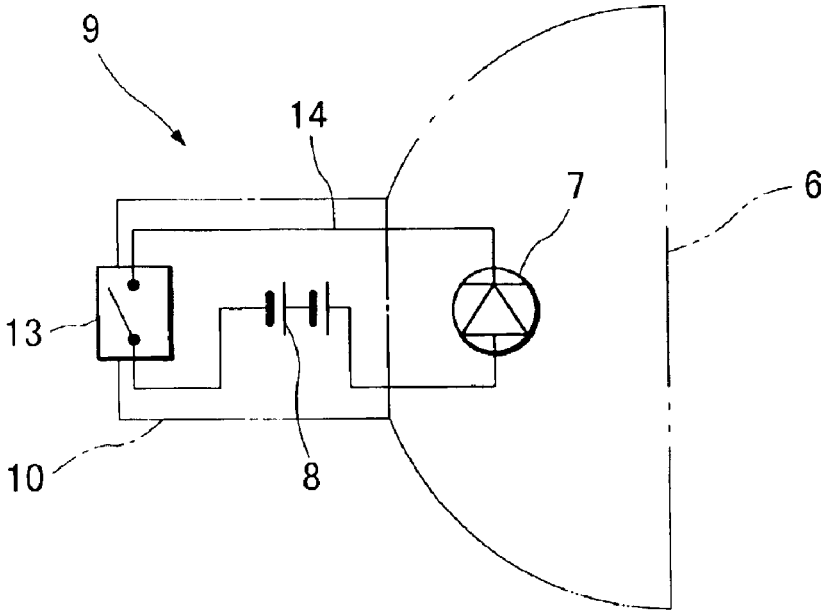
FIG. 9 is a circuit diagram of a lighting device.
Figure 10:
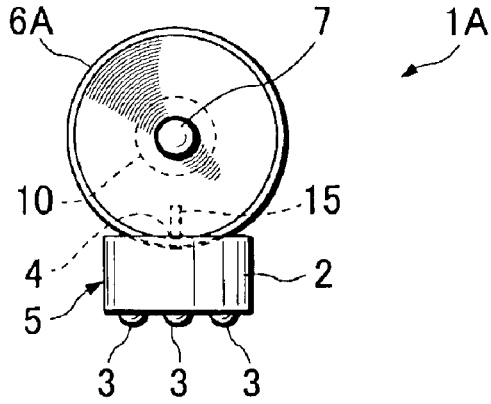
FIG. 10 is a front view showing a second embodiment of the present invention.
Figure 11:
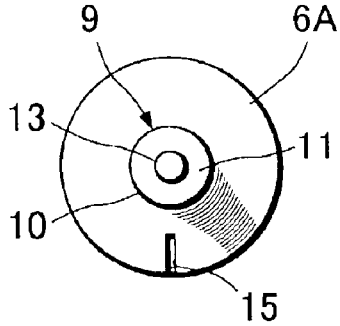
FIG. 11 is an explanation view of a reflector.
Figure 12:
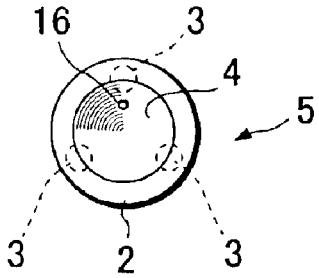
FIG. 12 is an explanation view of a support stand.
Figure 13:
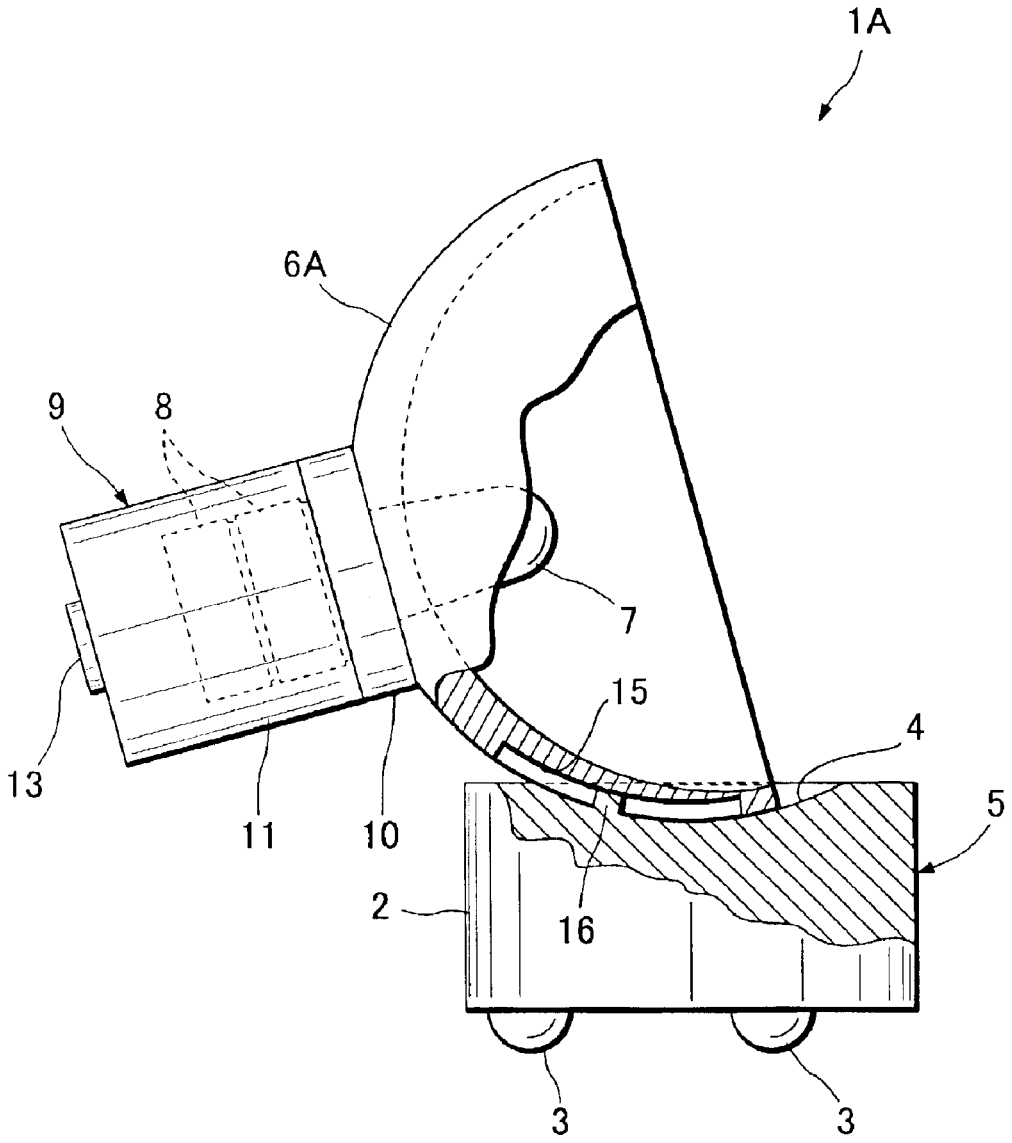
FIG. 13 is an expanded side view, partly in cross section.

As illustrated in FIG. 9, the lighting device 9 further includes a case body 10 fixed to a central portion of the reflector 6 so as to project in the outer direction, the luminous body 7 including the electric bulb and a light emitting diode, locating in the reflector 6, attached at the tip part of the case object 10, the battery 8, formed in the shape of a button, contained in the back end of the case body 10 through an openable cover 11, and a wiring 14 connecting the battery 8 and the luminous body 7 through a switch 13.

The electric light 1 for work of the above-mentioned composition is turned on the switch 13 of the lighting device 9 at the ON state and turns on the luminous body 7. Then the electric light 1 for work can be magnetically fixed to the support stand 5 at the metal portion by three leg members 3, 3, 3.

In this case, since the electric light 1 for work can illuminate in the horizontal lighting portion in case that the support stand 5 rotates in the vertical direction, and it can illuminate in the vertical lighting portion in case that the reflector 6 rotates vertically at a predetermined range, the work part to illuminate can be illuminated certainly.

Other embodiments of the present invention will now be described with reference to FIGS. 10–33. In FIGS. 10–33, the same components as in the first embodiment described above with reference to FIGS. 10–33 are designated by the same reference numerals and therefore will not be further explained in great detail.

A second embodiment of the present invention is shown in FIGS. 10 to 13. It is distinguished from the first embodiment by the fact that a reflector 6A having a guide slot 15 at a side of lower part thereof, formed in a shape of a prolonged hole, is used and an engage pin 16 is fixed to the support stand 5 so that the reflector 6A can be rotated in the vertical direction at a predetermined range. An electric light 1A for work according to the second embodiment has similar advantages to that according to the first embodiment and can prevent certainly by the engage pin 16 that the support stand 5 and reflector 6A separate.

Figure 14:
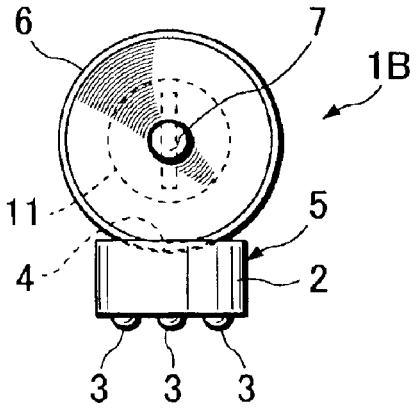
FIG. 14 is a front view showing a third embodiment of the present invention.
Figure 15:
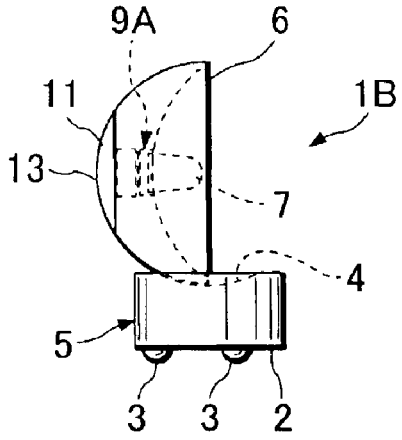
FIG. 15 is a side view.
Figure 16:
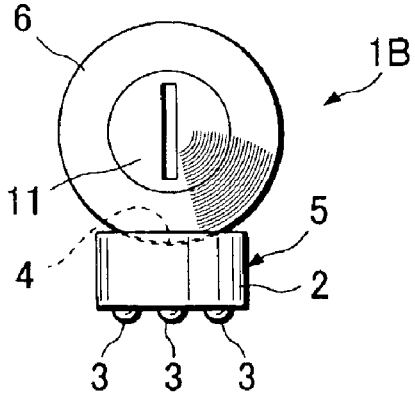
FIG. 16 is a back view.

A third embodiment of the present invention is shown in FIGS. 14 to 16. It is distinguished from the first embodiment by the fact that a lighting device 9A is arranged into the reflector 6. An electric light 1B for work according to the third embodiment has similar advantages to that according to the first embodiment.

Figure 17:
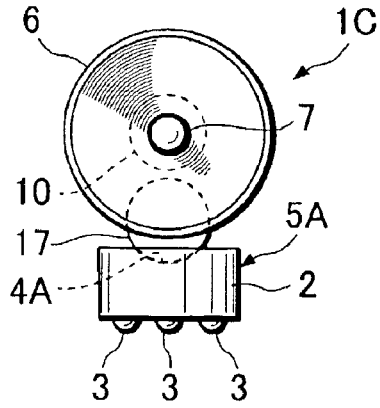
FIG. 17 is a front view showing a fourth embodiment of the present invention.
Figure 18:
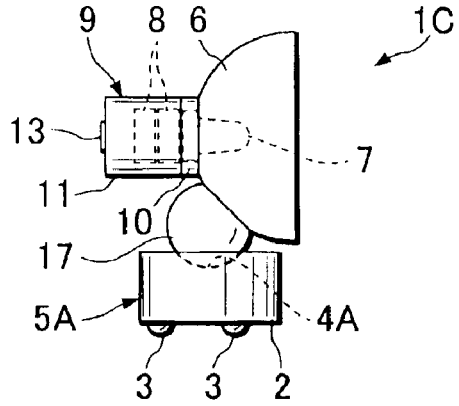
FIG. 18 is a side view.
Figure 19:
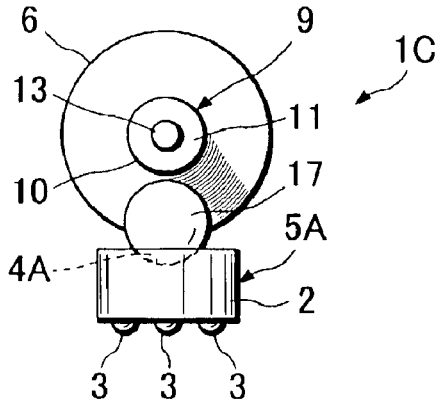
FIG. 19 is a back view.

A fourth embodiment of the present invention is shown in FIGS. 17 to 19. It is distinguished from the first embodiment by the fact that a support body 17 made from metal material, formed in the shape of a sphere substantially is formed in the outer surface of the reflector 6 and a support stand 5A has a concave member 4A which can adsorb and fix the support body 17 rotatably in the vertical direction at a predetermined range. An electric light IC for work according to the fourth embodiment has similar advantages to that according to the first embodiment.

Figure 20:
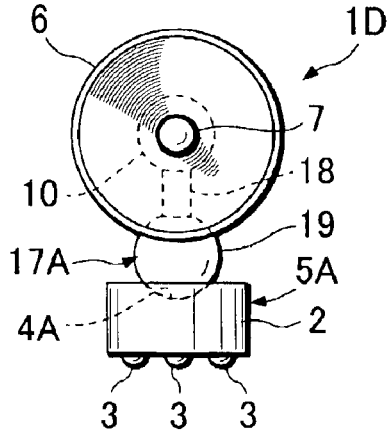
FIG. 20 is a front view showing a fifth embodiment of the present invention.
Figure 21:
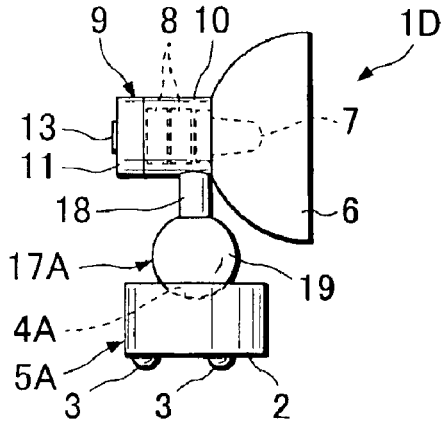
FIG. 21 is a side view.
Figure 22:
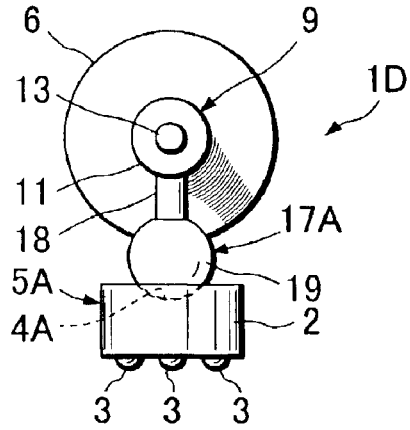
FIG. 22 is a back view.

A fifth embodiment of the present invention is shown in FIGS. 20 to 22. It is distinguished from the fourth embodiment by the fact that a rod 18 is fixed to the case body 10 of the lighting device 9 by welding etc. and a support body 17A includes a ball 19 supported by the concave member 4A of the support stand 5A. An electric light 1 D for work according to the fifth embodiment has similar advantages to that according to the fourth embodiment.

Figure 23:
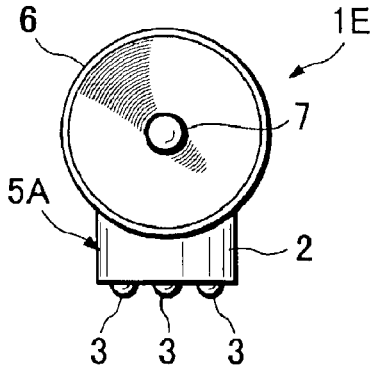
FIG. 23 is a front view showing a sixth embodiment of the present invention.
Figure 24:
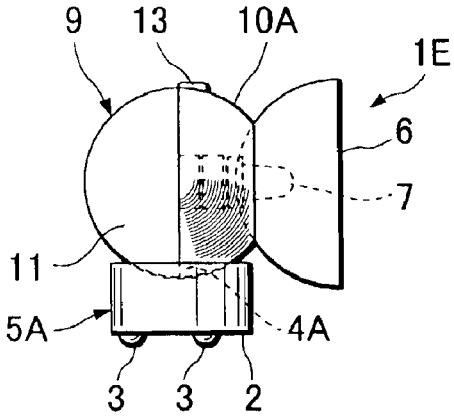
FIG. 24 is a side view.
Figure 25:
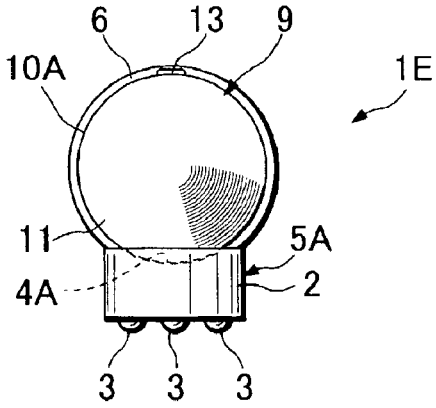
FIG. 25 is a back view.

A sixth embodiment of the present invention is shown in FIGS. 23 to 25. It is distinguished from the first embodiment by the fact that a case body 10A of the lighting device 9 is formed spherically and made from metal material and can be magnetically connected to the stand so that the lighting device can rotate against the concave member 4A of the support stand 5A at a predetermined range. An electric light 1E for work according to the sixth embodiment has similar advantages to that according to the first embodiment.

Figure 26:
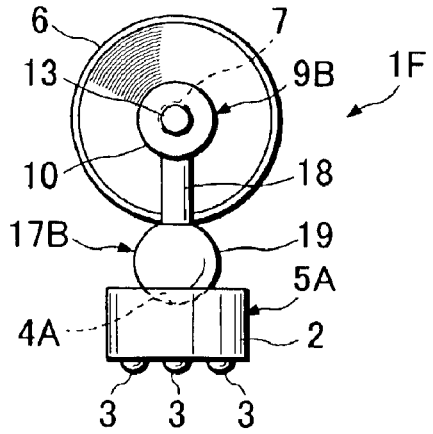
FIG. 26 is a front view showing a seventh embodiment of the present invention.
Figure 27:
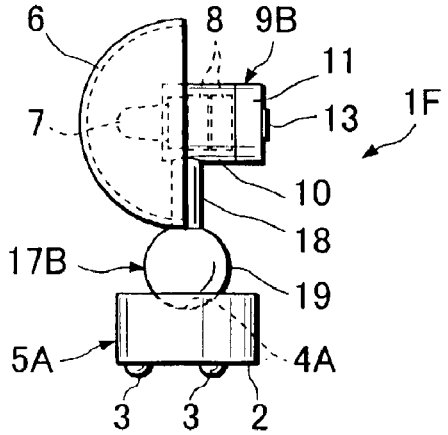
FIG. 27 is a side view.
Figure 28:
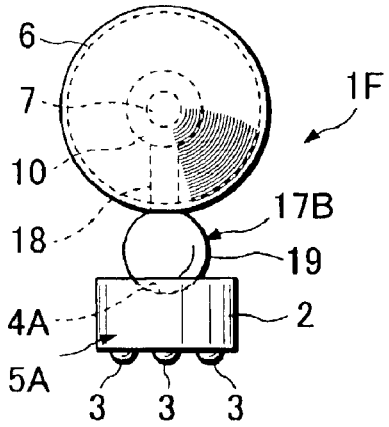
FIG. 28 is a back view.

A seventh embodiment of the present invention is shown in FIGS. 26 to 28. It is distinguished from the fifth embodiment by the fact that a lighting device 9B is arranged into the reflector 6, and it supported by a support body 17B fixed to the front part of the lower part of the reflector 6. An electric light IF for work according to the seventh embodiment has similar advantages to that according to the fifth embodiment.

Figure 29:
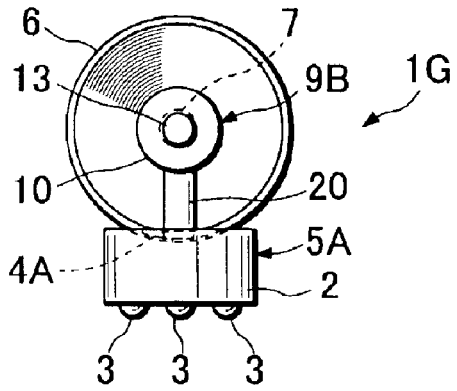
FIG. 29 is a front view showing an eighth embodiment of the present invention.
Figure 30:
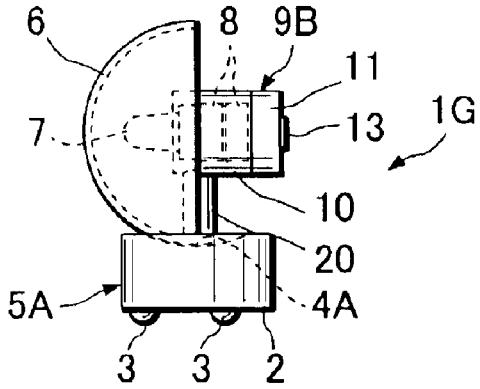
FIG. 30 is a side view.
Figure 31:
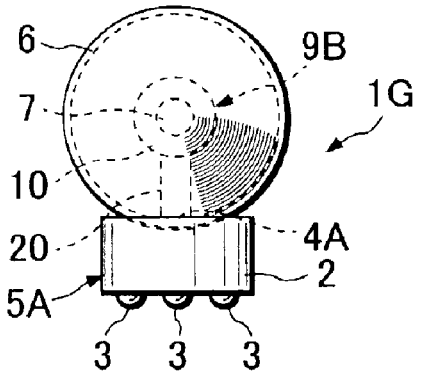
FIG. 31 is a back view.

An eighth embodiment of the present invention is shown in FIGS. 29 to 31. It is distinguished from the first embodiment by the fact that the lighting device 9B is fixed by the support pin 20 so that it locates into the reflector 6. An electric light 1G for work according to the eighth embodiment has similar advantages to that according to the first embodiment.

Figure 32:
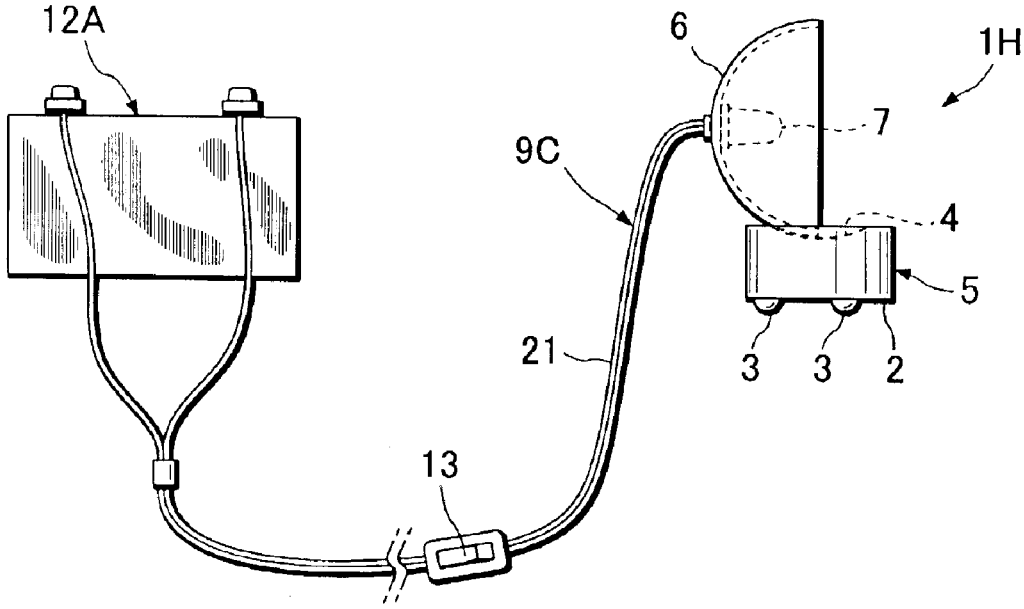
FIG. 32 is a side view showing a ninth embodiment of the present invention.

A ninth embodiment of the present invention is shown in FIG. 32. It is distinguished from the third embodiment by the fact that a lighting device 9C is connected to a battery 12A through a cord 21 and attached so that the luminous body 7 is arranged into the reflector 6. An electric light 1H for work with the lighting device 9C according to the third embodiment has similar advantages to that according to the third embodiment.

Figure 33:
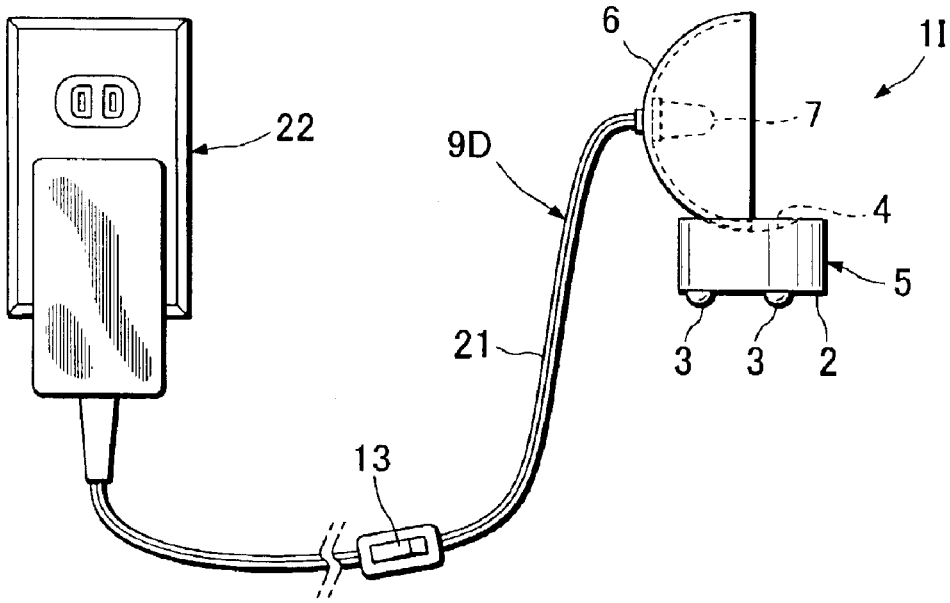
FIG. 33 is a side view showing a tenth embodiment of the present invention.

A tenth embodiment of the present invention is shown in FIG. 33. It is distinguished from the third embodiment by the fact that a lighting device 9D is connected to a commercial power supply 22 through the cord 21 and attached so that the luminous body 7 is arranged into the reflector 6. An electric light 11 for work with the lighting device 9D according to the third embodiment has similar advantages to that according to the third embodiment.

As set forth above, the advantages of the invention are as follows:

(1) Since the electric light for work comprises a support stand, capable of being magnetically connected to a metal surface; a reflector, formed in the shape of a semicircle arc, attached rotatably to the support stand in the vertical direction at a predetermined range; and a lighting device attached so that a luminous body is arranged into the reflector, illuminated the luminous body by a battery attached to the reflector, it can insert and fix to a metal surface and can illuminate.

Therefore, the worker can work with both hands, and an installation place can be set up comparatively freely.

(2) As discussed above, it can illuminate certainly in the state of pinpoint to a part to illuminate by rotating the support stand horizontally and rotating the reflector at a predetermined range in the vertical direction.

(3) As discussed above, since it can form in compact size, it can insert even in a narrow space so that a work place can be illuminated.

(4) As discussed above, the magnetism of the support stand can perform installation to arbitrary positions and fixation of the reflector. Therefore, it is easy to structure and can be manufactured cheaply.

What is claimed is:

1. An electric light for work comprising:

a support stand, capable of being magnetically fixed to a metal surface;

a metal reflector, formed in the shape of a semicircle arc and connected to said support stand;

a concave member, formed in the shape of an arc and capable of magnetically connecting said stand to said reflector so that said reflector may rotate about said concave member in the vertical direction in a predetermined range; and lighting circuitry located within said stand, said lighting circuitry capable of being connected to a luminous body and being powered by a battery for illuminating said reflector.

2. An electric light for work according to claim 1, wherein the support stand has three leg members, capable of being magnetically fixed and fixing to a metal surface.

3. An electric light for work according to claim 1 or 2, wherein the support stand includes the concave member formed in the shape of arc formed at the upper surface thereof, forming a diameter smaller than the diameter of the reflector made from metal material and formed in a shape of a semicircle arc.

4. An electric light for work comprising:

a support stand having three leg members, capable of being magnetically fixed to a metal surface;

a reflector formed in the shape of a semicircle arc, having a support body made from metal material and formed at outer surface thereof and in the shape of a sphere, said reflector being magnetically connected to said support stand so that said reflector is capable of rotating about said stand;

a concave mirror formed in the shape of arc and located at the upper surface of the support stand; and lighting circuitry located within said stand, said lighting circuitry capable of being connected to a luminous body and being powered by a battery for illuminating said reflector.

5. An electric light for work comprising:

a support stand having three leg members, capable of being magnetically fixed to a metal surface;

a reflector formed in the shape of a semicircle arc and fixed rotatably by magnetic power of the support stand to a concave member formed in the shape of arc formed at the upper surface of the support stand; and lighting circuitry located within said stand, said lighting circuitry capable of being connected to a luminous body and being powered by a battery or a commercial power supply for illuminating said reflector.

* * * * *